US008439697B2

(12) United States Patent
Vass

(10) Patent No.: US 8,439,697 B2
(45) Date of Patent: May 14, 2013

(54) LOCKING POWER CONNECTOR APPARATUS

(75) Inventor: Richard Anthony Vass, Bury St. Edmunds (GB)

(73) Assignee: Burland Technology Solutions Limited (GB)

( * ) Notice: Subject to any disclaimer, the term of this patent is extended or adjusted under 35 U.S.C. 154(b) by 66 days.

(21) Appl. No.: 13/062,670

(22) PCT Filed: Sep. 10, 2009

(86) PCT No.: PCT/IB2009/053970

§ 371 (c)(1), (2), (4) Date: May 23, 2011

(87) PCT Pub. No.: WO2010/029511

PCT Pub. Date: Mar. 18, 2010

(65) Prior Publication Data

US 2011/0237108 A1 Sep. 29, 2011

(30) Foreign Application Priority Data

Sep. 11, 2008 (GB) ..... 0816594.6

(51) Int. Cl.
*H01R 4/50* (2006.01)

(52) U.S. Cl.
USPC ..... 439/346; 439/270

(58) Field of Classification Search ..... 439/106, 439/263, 270, 304, 345, 346, 832, 953
See application file for complete search history.

(56) References Cited

U.S. PATENT DOCUMENTS

| | | | | |
|---|---|---|---|---|
| 4,846,707 | A | 7/1989 | Pirkle | |
| 4,909,749 | A * | 3/1990 | Long | 439/263 |
| 5,791,931 | A * | 8/1998 | Burkhart, Sr. | 439/346 |
| 6,193,539 | B1 * | 2/2001 | Chang | 439/346 |
| 7,083,458 | B1 * | 8/2006 | Chang | 439/346 |
| 7,172,451 | B1 * | 2/2007 | Ratzlaff | 439/346 |

(Continued)

FOREIGN PATENT DOCUMENTS

| | | | |
|---|---|---|---|
| GB | 2234402 | A | 1/1991 |
| GB | 2383202 | A8 | 6/2002 |
| GB | 2313240 | A | 6/2003 |

*Primary Examiner* — Thanh Tam Le

(74) *Attorney, Agent, or Firm* — Kirton McConkie; Michael F. Krieger

(57) ABSTRACT

The present invention relates to the field of electrical power connectors, and in particular power connectors that are used to connect a source of mains power to an item of electrical equipment. A locking panel socket (1) for making an electrical connection with a line plug comprises a socket connection portion (2) having an end face (11) and the end face having a plurality of recesses (10, 10') for receiving corresponding power pins of a line plug, a plug insertion channel (4) that extends around the socket connection portion (2) and a panel portion (6) that extends around the plug insertion channel (4). The locking panel socket (1) also includes within the socket connection portion a locking mechanism (12) for restraining a power pin of a line plug from being withdrawn from one of the recesses (10'), and a release mechanism for releasing the locking mechanism (12) to permit the power pin to be withdrawn from the recess. The release mechanism includes an actuation portion (60) and a linking portion (30, 46, 56) that links the actuation portion with the locking mechanism (12). The actuation portion (60) is manually accessible on the panel (6) and the linking portion (30, 46, 56) extends from the actuation portion (60) to the locking mechanism (12).

23 Claims, 2 Drawing Sheets

U.S. PATENT DOCUMENTS 7,232,349 B1 * 6/2007 Chen ..... 439/810
7,452,230 B1 * 11/2008 Miller et al. ..... 439/346
2005/0101169 A1 * 5/2005 Ratcliffe ..... 439/106
2008/0076291 A1 3/2008 Ewing

* cited by examiner

LOCKING POWER CONNECTOR APPARATUS

BACKGROUND a. Field of the Invention

The present invention relates to the field of electrical power connectors, and in particular power connectors that are used to connect a source of mains power to an item of electrical equipment.

b. Related Art

Items of electrical equipment used in the home or office environments may be connected to the mains supply by means of a power cable that has one end plugged into a mains wall socket. Instead of being permanently wired, the other end of the cable may terminate with a line socket that can be plugged into a matching plug. When the plug is provided on the chassis of the equipment, this is called a chassis plug or a panel plug.

The most common examples of such power connectors are those that adhere to the standards defined by the International Electrotechnical Commission (IEC) specification IEC 60320, particularly the C13 ad C14 connectors used with personal computer equipment and peripherals.

Some types of power connector are also available as line plug and panel socket versions, but these are less common. In the IEC specification, the term "connector" refers to line sockets (or panel sockets) and the term "inlet" refers to panel plugs (or line plugs).

The IEC standard includes two and three-conductor plugs of various current capacities and temperature ratings, all designed specifically for the purpose of attaching a mains power cord to a piece of electrical equipment. One of the main advantages of the IEC connector standard is that this allows for an interchangeable mains power cord, making it very easy for equipment manufacturers to sell their equipment anywhere in the world as long as their equipment can operate on both 120/240 volt, 50/60 Hz mains power.

One disadvantage of such connectors and inlets is that the joined connector and inlet can readily be pulled apart, which can happen when equipment is moved about or when a force is applied to the connecting cable resulting in an unexpected loss of power to equipment that is in use.

Patent document GB 2383202 A therefore proposes that a line socket has a power pin receptacle inside of which is a pivoting latch plate that has edges that allow a power pin to enter the receptacle but which dig in to the power pin when this is pulled in the opposite direction. The power pin, and hence the rest of the panel plug, are therefore locked to the line socket.

The pivoting latch plate is biased by means of a coil spring towards the orientation in which the edges dig into the engaged power pin. The spring acts on an elongate slide piece which when moved against the biasing force of the spring along an axis parallel with the power pin insertion direction causes the latch plate to pivot towards an orientation which the latch plate edges no longer dig in to the engaged power pin. The slide piece has a catch that extends transversely from an end of the slide piece out of a slot in the main body of the line socket so that the slide piece can be manually moved to release the line socket from the panel plug when this is desired.

This arrangement works well but is only suitable for use with a line socket and a panel plug, not a panel socket and a line plug. This is because the elongate slide pin extends away from the front face of the socket into the body of the socket. It is only because the line socket has an accessible main body portion that the transverse latch on the slide portion can be manually accessed to manually move the elongate slide pin to release the locking mechanism. Such an arrangement is not possible with a panel socket where the main body of the panel socket will normally be concealed behind a surrounding panel or face plate.

It is an object of the present invention to provide a locking power connector apparatus having a panel socket.

SUMMARY OF THE INVENTION

According to the invention there is provided a locking panel socket for making an electrical connection with a line plug, the locking panel socket comprising:

- a socket connection portion, the socket connection portion having an end face and the end face having a plurality of recesses for receiving corresponding power pins of a line plug;
- a plug insertion channel, the plug insertion channel extending around the socket connection portion;
- a panel portion, the panel portion extending around the plug insertion channel;
- a locking mechanism for restraining a power pin of a line plug from being withdrawn from at least one of said recesses, the locking mechanism being provided within the socket connection portion;
- a release mechanism for releasing the locking mechanism to permit said power pin to be withdrawn from said recess, the release mechanism including an actuation portion and a linking portion that links the actuation portion with the locking mechanism;
- wherein the actuation portion is manually accessible on said panel and the linking portion extends from the actuation portion to the locking mechanism.

In a preferred embodiment of the invention, the locking mechanism is a pivoting latch plate that has edges that allow a power pin to enter the receptacle but which dig in to the power pin when this is pulled in the opposite direction. The power pin, and hence the rest of the line plug, are therefore locked to the panel socket.

When a user plugs a line plug into the panel socket, the locking mechanism will therefore lock the pin, and hence the plug, in place. When the user wishes to disconnected the line plug from the panel socket, the user can use the actuation portion on the panel to disengage the locking mechanism and then remove the line plug. The actuation portion is preferably a button that extends proud of the panel.

The linking mechanism may include on opposite sides of the plug insertion channel a first portion and a second portion.

In a preferred embodiment of the invention, the first portion extends away from the actuation portion in a first direction transverse, and most preferably perpendicular, to the plane of the panel. The second portion then extends in a second direction opposite to the first direction towards the locking mechanism.

The linking mechanism may include a third portion that extends between the first and second portions beneath a base of the plug insertion channel. It is preferred if the linking portion is not of a unitary construction, but is composed of separate pieces. The third portion may be integral with either the first or second portions of the linking portion, but is preferably integral with the second portion.

The first portion may be a rod that terminates with the actuation portion. The actuation portion, when manually pushed, causes the first portion to act on the third portion and thereby pull the second portion in a direction parallel to the motion of the first portion to disengage the locking mechanism from the power pin of a line plug.

The invention also provides a locking power connector apparatus, comprising a locking panel socket and a line plug for electrical connection with the locking panel socket, in which the locking panel socket is according to the invention.

BRIEF DESCRIPTION OF THE DRAWINGS

The invention will now be further described, by way of example only, with reference to the accompanying drawings, in which.

DETAILED DESCRIPTION

Figure 3:
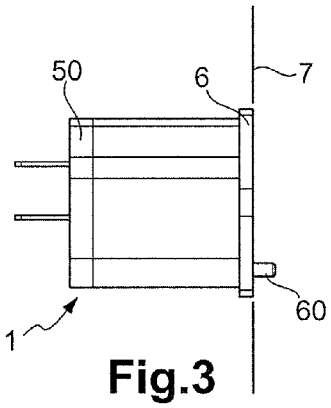
FIG. 3 is a side view of the panel socket of FIG. 2A.

FIGS. 1-4 show various views of a locking panel socket 1, having a socket connection portion 2 that is surrounded by a plug insertion channel 4 which is itself surrounded by a panel portion 6. The socket connection portion 2, channel 4 and panel portion share a common main body 5.

The panel portion 6 takes the form of a flange having a pair of holes 8 by which the flange 6 may be secured to an item of equipment, for example the chassis of an electronic device or a power distribution strip (not shown).

In the example, the panel socket 1 confirms to the IEC C13 and C14 standards.

The socket connection portion 2 has three recesses 10, 10' formed in an end face 11 for receiving three corresponding pins of a line plug (not shown), also confirming the IEC standard. Such pins are provided within a protective shroud of the line plug. The channel 4 is sized to receive and hold the shroud securely.

Figure 4:
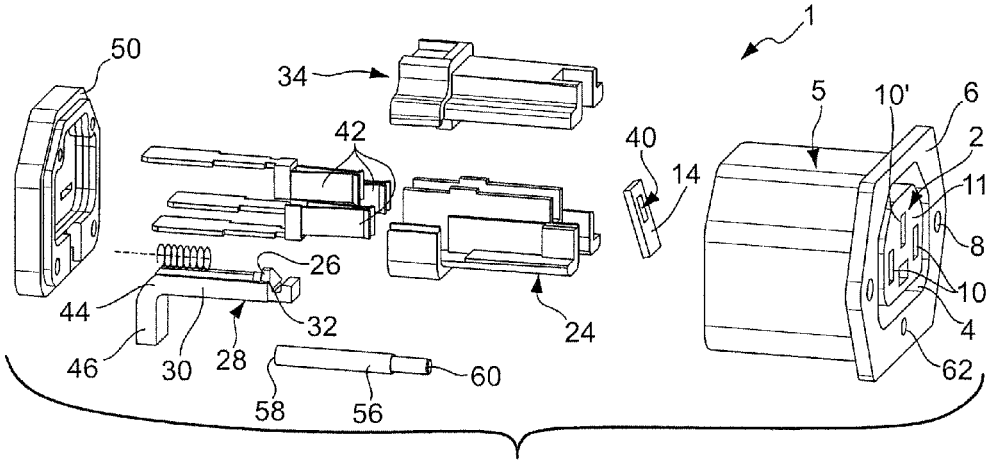
FIG. 4 is an exploded view of the panel socket of FIG. 1.

The end face 11 and surrounding flange 6 are co-planar as indicated by dashed line 7 in FIG. 4.

Figure 2A:
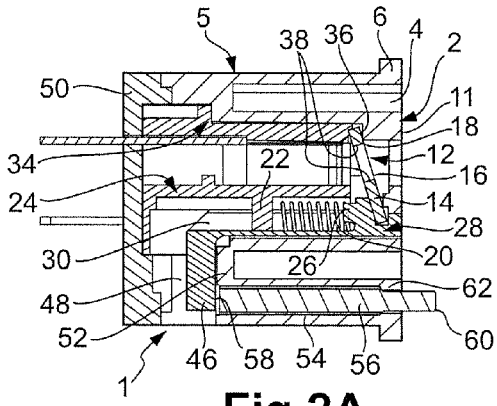
FIGS. 2A and 2B show cross-sections through the panel socket, taken along line II-II of FIG. 1, showing a locking mechanism and release mechanism in, respectively, locked and open states.
Figure 1:
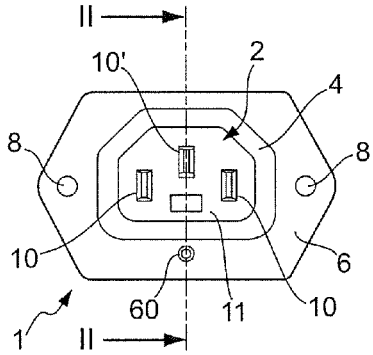
FIG. 1 is a front view of a locking panel socket according to a preferred embodiment of the invention, showing three recesses in a socket connector portion bounded by a plug insertion channel which is itself surrounded by a panel.

The end face 11 is bounded by the surrounding channel 4. One of the recesses 10' includes a locking mechanism 12 in the form of a pivoting latch plate 14 that has edges 16, 18 that engage with an inserted power pin. This locking mechanism is the same as that disclosed in patent document GB 2 383 202 A. The pivoting latch plate 14 is biased towards a locking orientation, as shown in FIG. 2A, by means of a coil spring 20 that is compressed between a ledge 22 on a stationary bottom insert 24 and a cylindrical boss 26 that is part of a slide piece 28 within the socket portion 2.

Figure 2B:
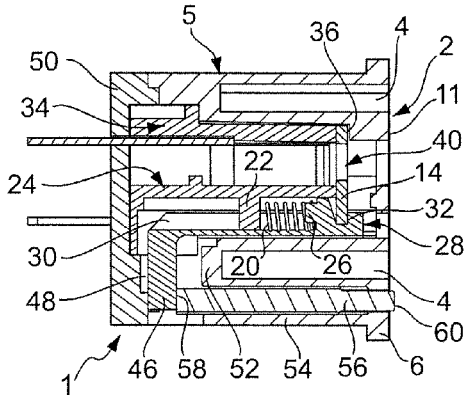

The slide piece 28 has an elongate arm 30 that extends in a direction parallel to the sliding direction of motion of the slide piece. The end of the arm 30 nearest the end face 11 of the socket portion has a gripping feature 32 that engages with one end of the pivoting latch plate 14. The other end of the latch plate 14 is held in place but free to pivot between an upper insert 34 and a ledge 36 within the socket portion 2. When the slide piece 28 is moved relatively towards and away from the end face 11, the pivoting latch plate 14 is moved from a tilted orientation as shown in FIG. 2A to a straight orientation parallel with the end face 11, as shown in FIG. 2B. When the latch plate 14 is titled, upper and lower edges 38 in an aperture 40 through the latch plate 14 dig into an inserted plug pin, thereby maintaining electrical contact with three blade-type contacts 42 secured between the lower and upper inserts 24, 34.

The end of the slide piece 28 furthest from the end face 11 terminates in an elbow 44 and a transverse section 46 that extends into a slot 48 between a rear cover 50 and a portion of a wall 52 in the main body 5 that defines the bottom of the plug insertion channel 4. The contact of the transverse portion 46 with the rear cover 50 and wall 52 sets the limit of travel of the slide piece 28.

A cylindrical channel 54 extends through the main body 5 of the panel socket 1, laterally outside the channel 4, in a direction parallel with the insertion direction of plug pins and perpendicular with the plane 7 defined by the end face 11 and surrounding flange 6. A stepped cylindrical rod 56 is slidably held in the channel 54. One end 58 of the rod 56 comes into contact with the transverse portion 46 of the slide piece 28, while the opposite end 60 extends through a hole 62 in the surrounding flange 6. The hole 62 and the rod end 60 are of reduced diameter as compared with the a central portion of the cylindrical rod 56 so that this is retained within the main body 5 of the panel socket 1.

As shown in FIG. 2A, when the locking mechanism is in the locked condition, the transverse portion 46 of the slide piece 28 forces the rod forwards so that the end portion 60 stands proud of the panel 6. This end portion 60 serves as an actuation portion of a release mechanism which, when depressed, moves the rod 56 and slide piece 28 to rotate the latching plate 14 to the straight orientation as shown in FIG. 2B. The rod 56 and the transverse and arm portions 46, 30 of the slide piece 28 therefore act as a linking portion of a release mechanism that links the actuation portion 60 with the locking mechanism 12.

A user can therefore easily disengage a locked line plug from the locking panel socket 1 by pushing on the exposed rod end portion 60 to disengage the locked line plug.

Figure 5:
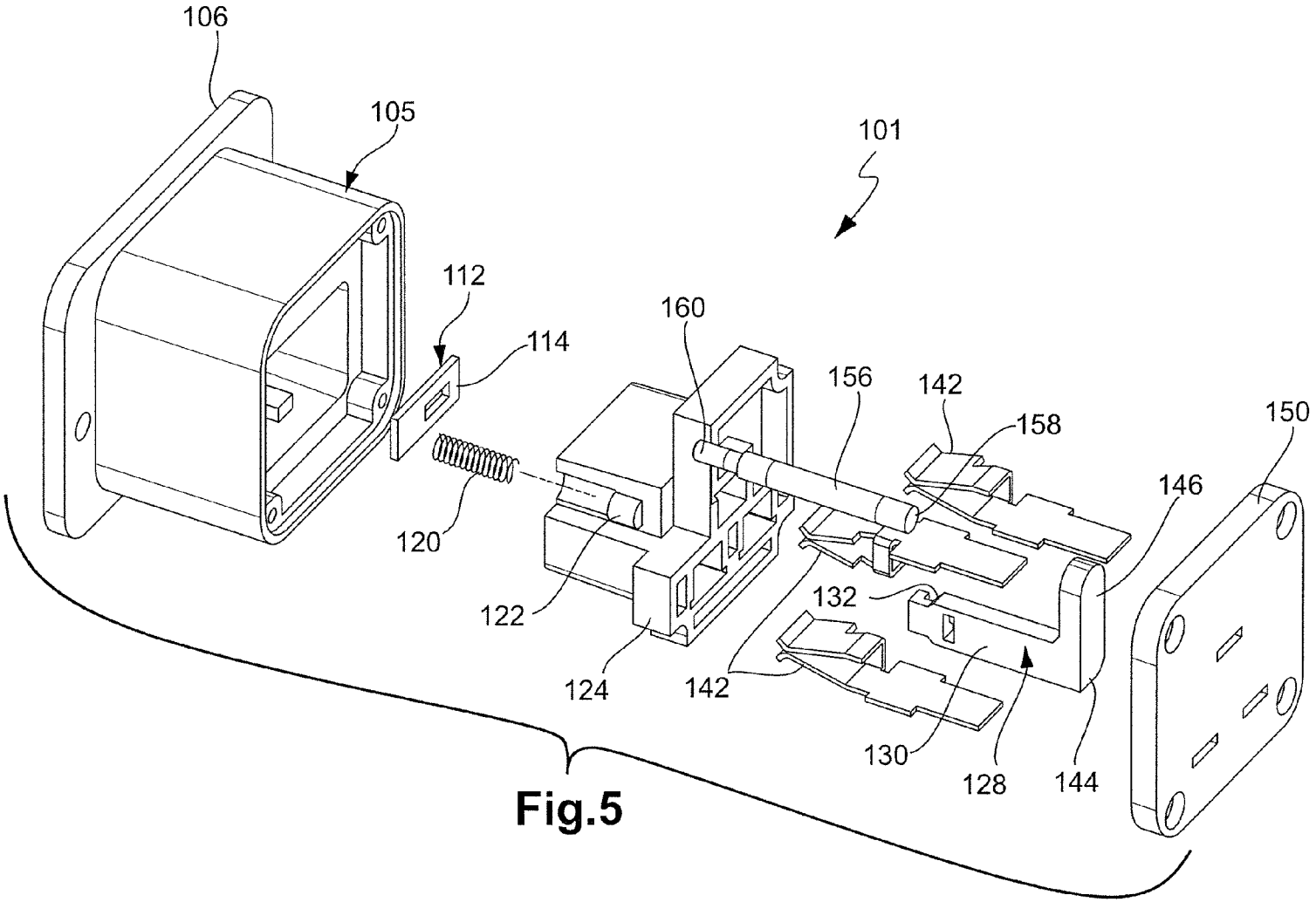
FIG. 5 is an exploded view of a locking panel socket according to a second embodiment of the invention.

FIG. 5 shows a second embodiment of the invention, in which features corresponding with those of FIGS. 1-4 are indicated by reference numerals incremented by 100. The locking panel socket 101 shown in FIG. 5 differs from that in the first embodiment in that the transverse portion 146 extends in a direction that is at right angles to the length of the pivoting latch plate 114, rather than in a direction that is substantially parallel with that of the pivoting latch plate 14. The effect conferred by the transverse portion 146 is, however, the same as that in the first embodiment when this is engaged with the cylindrical rod 156. When the protruding end portion 160 of the rod 156 is pressed, the end 158 of the rod engages with the transverse portion 146 to move the slide piece 128 inwards to rotate the latch plate 114 to a straight orientation in which the plug pin is disengaged so that the line plug can be withdrawn from the locking panel socket 101. Thus, the shape of the slide piece can be altered in order to change the location of the actuation portion on the surrounding panel. The arrangement shown in FIG. 5 also permits the use of a single insert 124, rather than the split lower and upper inserts 24, 34 of the first embodiment, which can simplify the assembly of the locking panel socket 101.

In both of the embodiments described above, the actuation portion 60, 160, when depressed, causes the linking portion 30, 46, 56 or 130, 146, 156 to disengage the locking mechanism 12, 112 from the power pin of the line plug to unlock the line plug from the locking panel socket 1, 101. The invention therefore provides a convenient a locking panel socket and locking power connector apparatus.

As the skilled person will appreciate, although the invention has been described above with reference to an IEC connector, the invention is applicable to other types of electrical power connector not necessarily conforming to the IEC connector standards.

The invention claimed is:

1. A locking panel socket for making an electrical connection with a line plug, the locking panel socket comprising:

a socket connection portion, the socket connection portion having an end face and the end face having a plurality of recesses for receiving corresponding power pins of the line plug;

a plug insertion channel, the plug insertion channel extending around the socket connection portion;

a panel portion, the panel portion defining a plane and extending around the plug insertion channel;

a locking mechanism which, in use, engages with one of said power pins when said pin is inserted into one of said recesses to restrain said line plug from being withdrawn from at least one of said recesses, the locking mechanism being provided within the socket connection portion;

a release mechanism for releasing the locking mechanism to permit said power pin to be withdrawn from said recess, the release mechanism including an actuation portion and a linking portion that links the actuation portion with the locking mechanism;

wherein the actuation portion is manually accessible on said panel portion and the linking portion extends from the actuation portion to the locking mechanism, and the linking portion includes a first portion and a second portion, said first and second portions of the linking portion being on opposite sides of the plug insertion channel within a body of the panel socket such that said first portion is located on the side of the plug insertion channel having the panel portion of the panel socket and said second portion is located on the side of the plug insertion channel having the socket connection portion of the panel socket, said first portion extending away from the actuation portion in a first direction transverse to the plane of the panel portion and said second portion extending in a second direction, said second direction being parallel and opposite to the first direction such that said second portion extends towards the locking mechanism.

2. The locking panel socket as claimed in claim 1, in which the actuation portion is a button that extends proud of the panel.

3. The locking panel socket as claimed in claim 1, in which the first portion of the linking portion extends away from the actuation portion in the first direction perpendicular to the plane of the panel portion.

4. The locking panel socket as claimed in claim 1, in which the locking mechanism is a pivoting latch plate that has edges that allow one of said power pins to enter said recess but which dig in to the power pin when this is pulled in the opposite direction.

5. The locking panel socket as claimed in claim 1, in which the linking portion is not of a unitary construction, but is composed of separate pieces.

6. The locking panel socket as claimed in claim 1, in which the plug insertion channel has a base, and the linking portion includes a third portion that extends within a body of the panel socket such that said third portion is beneath the base of the plug insertion channel and extends between said first and second portions of the linking portion.

7. The locking panel socket as claimed in claim 6, in which the third portion of the linking portion is integral with the second portion of the linking portion.

8. The locking panel socket as claimed in claim 1, in which said first portion is a rod that terminates with the actuation portion.

9. The locking panel socket as claimed in claim 8, in which the actuation portion, when manually pushed, causes the first portion of the linking portion to act on the third portion of the linking portion and thereby pull the second portion of the linking portion in a direction parallel to the motion of said first portion to disengage the locking mechanism from the power pin of the line plug.

10. A locking power connector apparatus, comprising:

a locking panel socket; and a line plug for electrical connection with the locking panel socket;

wherein the locking panel socket comprises, a socket connection portion, the socket connection portion having an end face and the end face having a plurality of recesses for receiving corresponding power pins of the line plug;

a plug insertion channel, the plug insertion channel extending around the socket connection portion;

a panel portion, the panel portion defining a plane and extending around the plug insertion channel;

a locking mechanism which, in use, engages with one of said power pins when said pin is inserted into one of said recesses to restrain said line plug from being withdrawn from at least one of said recesses, the locking mechanism being provided within the socket connection portion;

a release mechanism for releasing the locking mechanism to permit said power pin to be withdrawn from said recess, the release mechanism including an actuation portion and a linking portion that links the actuation portion with the locking mechanism;

wherein the actuation portion is manually accessible on said panel portion and the linking portion extends from the actuation portion to the locking mechanism, and the linking portion includes a first portion and a second portion, said first and second portions of the linking portion being on opposite sides of the plug insertion channel within a body of the panel socket such that said first portion is located on the side of the plug insertion channel having the panel portion of the panel socket and said second portion is located on the side of the plug insertion channel having the socket connection portion of the panel socket, said first portion extending away from the actuation portion in a first direction transverse to the plane of the panel portion and said second portion extending in a second direction, said second direction being parallel and opposite to the first direction, such that said second portion extends towards the locking mechanism.

11. The locking power connector apparatus as claimed in claim 10, in which:

the actuation portion stands proud of the panel when the line plug is connected and locked with the locking panel socket; and the actuation portion, when depressed, causes the linking portion to disengage the locking mechanism from the power pin of the line plug to unlock the line plug from the locking panel socket.

12. The locking panel socket as claimed in claim 10, in which the first portion of the linking portion extends away from the actuation portion in a first direction perpendicular to the plane of the panel portion.

13. The locking panel socket as claimed in claim 10, in which the locking mechanism is a pivoting latch plate that has edges that allow a power pin to enter said recess but which dig in to the power pin when this is pulled in the opposite direction.

14. The locking panel socket as claimed in claim 10, in which the linking portion is not of a unitary construction, but is composed of separate pieces.

15. A locking panel socket for making an electrical connection with a line plug, the locking panel socket comprising:

a socket connection portion, the socket connection portion having an end face and the end face having a plurality of recesses for receiving corresponding power pins of the line plug;

a plug insertion channel, the plug insertion channel extending around the socket connection portion;

a panel portion, the panel portion defining a plane and extending around the plug insertion channel;

a locking mechanism which, in use, engages with one of said power pins when said pin is inserted into one of said recesses to restrain said line plug from being withdrawn from at least one of said recesses, the locking mechanism being provided within the socket connection portion;

a release mechanism for releasing the locking mechanism to permit said power pin to be withdrawn from said recess, the release mechanism including an actuation portion and a linking portion that links the actuation portion with the locking mechanism;

wherein the actuation portion is manually accessible on said panel portion and the linking portion extends from the actuation portion to the locking mechanism, and the linking portion includes a first portion and a second portion, said first and second portions of the linking portion being on opposite sides of the plug insertion channel within a body of the panel socket such that said first portion is located on the side of the plug insertion channel having the panel portion of the panel socket, the linking portion not being of unitary construction, but being composed of separate pieces, said first portion extending away from the actuation portion in a first direction transverse to the plane of the panel portion and said second portion extending in a second direction, said second direction being parallel and opposite to the first direction, such that said second portion extends towards the locking mechanism.

16. The locking panel socket as claimed in claim 15, in which the first portion of the linking portion is a separate piece from the second portion of the linking portion.

17. The locking panel socket as claimed in claim 15, in which the actuation portion is a button that extends proud of the panel.

18. The locking panel socket as claimed in claim 15, in which the first portion of the linking portion extends away from the actuation portion in a first direction perpendicular to the plane of the panel portion.

19. The locking panel socket as claimed in claim 15, in which the locking mechanism is a pivoting latch plate that has edges that allow a power pin to enter said recess but which dig in to the power pin when this is pulled in the opposite direction.

20. The locking panel socket as claimed in claim 15, in which the plug insertion channel has a base, and the linking portion includes a third portion that extends between said first and second portions of the linking portion beneath the base of the plug insertion channel.

21. The locking panel socket as claimed in claim 20, in which the third portion of the linking portion is integral with the second portion of the linking portion.

22. The locking panel socket as claimed in claim 15, in which said first portion is a rod that terminates with the actuation portion.

23. The locking panel socket as claimed in claim 22, in which the actuation portion, when manually pushed, causes the first portion of the linking portion to act on the third portion of the linking portion and thereby pull the second portion of the linking portion in a direction parallel to the motion of said first portion to disengage the locking mechanism from the power pin of the line plug.

* * * * *